US005201471A

United States Patent [19]

Janway et al.

[11] Patent Number: 5,201,471

[45] Date of Patent: Apr. 13, 1993

[54] METHOD FOR OPERATING A ROD MILL TO OBTAIN UNIFORM PRODUCT SLURRY

[75] Inventors: Neal W. Janway, Baton Rouge; William P. White, Greenwell Springs, both of La.

[73] Assignee: The Dow Chemical Company, Midland, Mich.

[21] Appl. No.: 891,552

[22] Filed: May 29, 1992

[51] Int. Cl.[5] ..... B02C 25/00

[52] U.S. Cl. ..... 241/21; 241/34

[58] Field of Search ..... 241/15, 21, 33, 34, 241/35, 63

[56] References Cited

U.S. PATENT DOCUMENTS

| | | | |
|---|---|---|---|
| 4,210,290 | 7/1980 | Andersson et al. | 241/34 X |
| 4,481,015 | 11/1984 | Lusch et al. | 241/34 X |
| 4,597,535 | 7/1986 | Fontanille | 241/34 X |

FOREIGN PATENT DOCUMENTS

| | | | |
|---|---|---|---|
| 1428470 | 10/1988 | U.S.S.R. | 241/34 |

OTHER PUBLICATIONS

B. P. Faulkner, et al., "Silver and Silver Alloys to Sulfolanes and Sulfones", *Kirk-Othmer Encyclopedia of Chemical Technology*, Third Edition, vol. 21, pp. 154–162.

*Primary Examiner*—Douglas D. Watts

[57] ABSTRACT

A method for operating a rod mill so that a uniform slurry is produced by controlling the ratio of solid friable material to liquid material fed by determining the current drawn on the rod mill motor and using this as the set point to feed the liquid material to the solid friable material forming a slurry of comminuted solids of a uniform nature which allows the rod mill to operate at the set current draw.

11 Claims, 1 Drawing Sheet

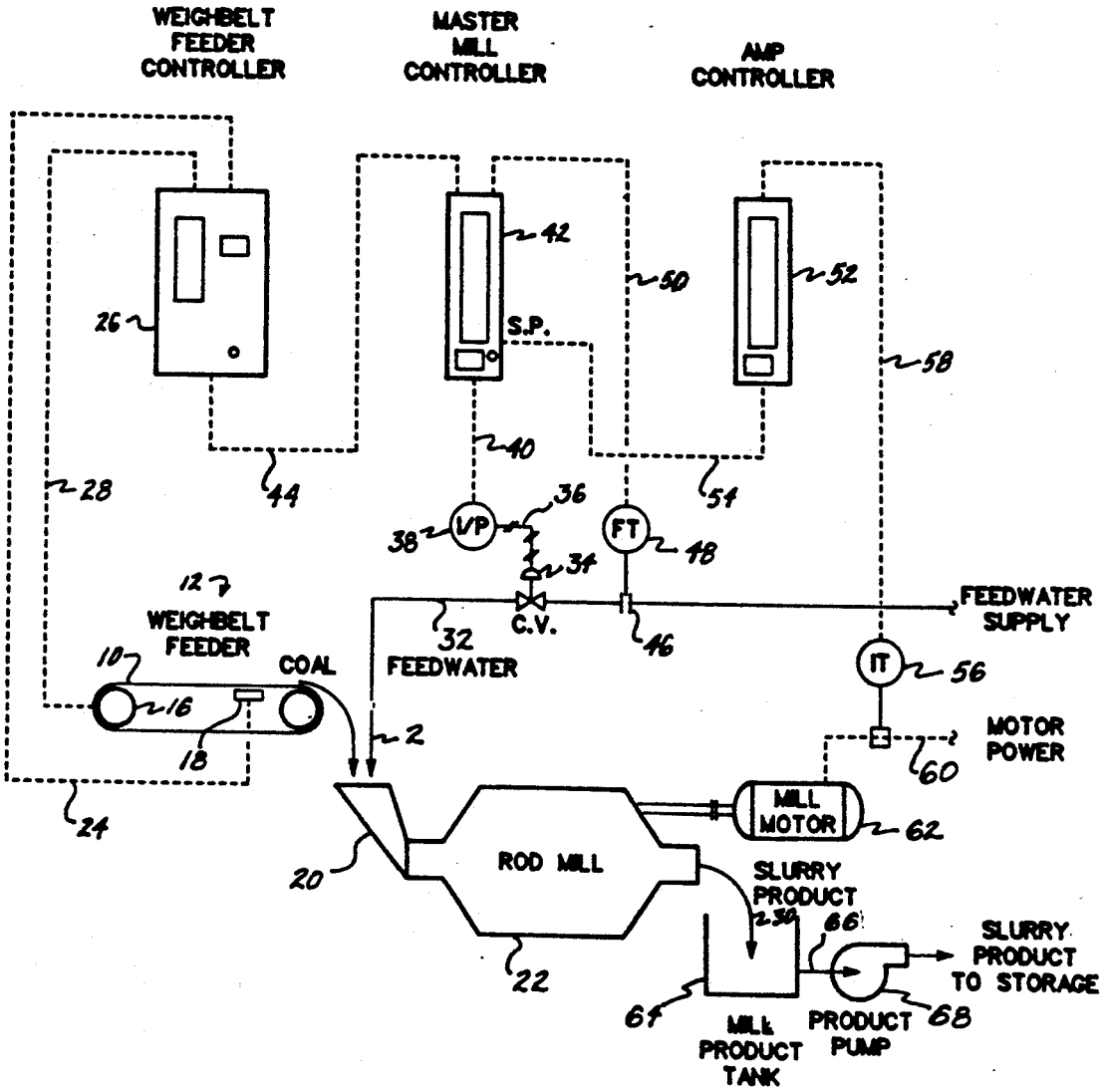
WEIGHBELT FEEDER CONTROLLER
MASTER MILL CONTROLLER
AMP CONTROLLER
S.P.
I/P
FT
IT
C.V.
FEEDWATER SUPPLY
FEEDWATER
WEIGHBELT FEEDER
COAL
MOTOR POWER
MILL MOTOR
ROD MILL
SLURRY PRODUCT
SLURRY PRODUCT TO STORAGE
MILL PRODUCT TANK
PRODUCT PUMP
2
10
12
16
18
20
22
24
26
28
32
34
36
38
40
42
44
46
48
50
52
54
56
58
60
62
64
66
68

METHOD FOR OPERATING A ROD MILL TO OBTAIN UNIFORM PRODUCT SLURRY

BACKGROUND OF THE INVENTION

This invention relates to a method for producing uniform and consistent slurries of a communited solid friable material and a liquid material. More particularly, this invention relates to a method for operating a rod mill to provide a uniform and consistent slurry having a high solids content, but which is still capable of being pumped and transported in relatively stable form.

Rod mills have been in use in industry for many years. Their function of size reduction of various solid materials is well known and thoroughly evaluated. As stated in Kirk-Othmer, *Encyclopedia of Chemical Technology*, (Third Ed.), Vol. 21, pages 154–161, rod mills are one form of tumbling mills in which the grinding medium is a number of rods having one dimension several times the other and which are characterized by a cylinder containing the grinding medium rotating about a horizontal, or nearly horizontal, axis. The comminuting action takes place by the material being caught between grinding medium elements (rods) and the cylinder wall, by rolling-action encounters between the medium and the material and by impacts from the media. In general, rod mills have unique design characteristics inherent in the type of discharge means, i.e., overflow, endperipheral or centerperipheral. For each discharge type several characteristics will bear on the selection of one type of rod mill or the other, including the type of process, either wet or dry; the maximum reduction ratios; typical product size; and recommended rotating speed.

Size reduction and particularly rod mills are used in the chemical process industries mainly in the preparation of mineral feed stocks, e.g., limestone plus lime, phosphate rock, coal (as a chemical feedstock), silica plus feldspars, etc. With impure minerals, the size-reduction step may be incorporated into a mineral-processing plant to upgrade the ore to meet user specifications. Lesser but still important applications exist in coal pulverization for fuel, in the preparation of suitably sized products for sale, or in the preparation of gasification slurry feedstocks. Typical examples of size reduction for ores and minerals are the taconite (low grade iron ore) industry, in which a large-scale minerals processing plant utilized staged comminution with intermediate size separation and beneficiation to upgrade ores containing 20–40% Fe to a blast furnace feed of 64% Fe. In industrial nonmetallic minerals, such as the processing of limestone, the mineral is reduced from run-of-mine stone to desired sizes, primarily by open circuit jaw crushers, gyratories, or impact breakers, and then further with open or closed circuit cone crushers, hammer mills, or cage mills and occasionally roll crushers or rod mills. Fine grinding or pulverizing is carried out in hammer mill, cage mill, roller mills, and rod, ball, tube, pebble and vibrating mills. Other minerals of importance include phosphate rock for fertilizers; silica and feldspars for glass, ceramic, and refractories; and sylvinite ($\gamma$NaCl.KCl) for the preparation of KCl, principally for fertilizers. The materials required for portland cement manufacture are lime, alumina, and silica obtained from limestone, shale, clay, or cement rock. Run-of-mine stone is first crushed in jaw crushers, gyratories, impact crushers, or toothed rolls, then blended in appropriate proportions and ground to 75–90% passing 75$\mu$in wet or dry circuits. Modern plants prefer dry grinding in order to minimize fuel requirements for drying before calcination. Grinding is carried out, frequently in a single stage, in roller mills, ball mills, tube mills (long ball mills), and compartmented ball mills (2–3 compartments charged with different ball sizes). The material is dried in a separate dryer or in a mill-classifier closed circuit, employing waste heat from the cement kiln. Rod mills can also be used in this service. Pulverized coal is principally used in mainly bituminous form for combustion for energy and carbonization for coke, tar, coal, chemicals, and gas production.

In view of the important processes and industries requiring size reduction and using rod mills therefor, a method for operating a rod mill which provides for more precise control of the product and a more uniform product is not only desirable, but also necessary from a quality and competition standpoint. Therefore, one of the objects of this invention is to provide a method for operating a rod mill so that control of the mill is more precise and so that a uniform product slurry is obtained. These and other objects, which will be clear from the specification and which provide satisfaction in use, are provided by the present invention.

SUMMARY OF THE INVENTION

The present invention features a method for operating a rod mill for the production of a uniform product slurry, said method comprising the steps of a) weighing a solid friable material on a continual basis as a first feed stream to the inlet chute of the rod mill,
b) measuring a liquid material as a second feed stream to the chute,
c) feeding to the chute a predetermined ratio of the first feed stream and the second feed stream, the second feed stream forming the continuous phase of said slurry, and
d) controlling the second feed stream in relation to the first feed stream so that the predetermined amount of current drawn by the motor for rotation of the rod mill will result in a consistent solids concentration, thereby forming a uniform slurry product of predetermined solids concentration based on the ratio of the friable solid material to the liquid material fed and the current drawn by the motor.

The materials which include the solid friable material include low grade iron ores, such as taconite, nonmetallic minerals, such as limestone, phosphate rock, silica, feldspar, shale cement rock and sylvinite. Further processed intermediates and agglomerates of the above may be processed by means of the present invention. Coal, such as subbituminous or bituminous coals, can be preferably size reduced by the method of the present invention. However, the material processed is not critical because any material generally processed in rod mills can be employed in the process or method of this invention.

DESCRIPTION OF THE DRAWING

FIG. 1 is a schematic drawing of a rod mill train useful in this invention and showing a control loop for operating the rod mill by the method of the present invention.

DETAILED DESCRIPTION OF THE INVENTION

As shown in FIG. 1, which for purposes of illustration only uses coal, indicated schematically by the arrow at 1, as the material for size reduction, a coal source, not shown, such as a feed hopper which is filled from a coal supply pile, feeds a coarse coal product onto the conveyor belt 10 of a weighbelt feeder 12. As the conveyor belt 10 turns over idle pulley 14 and driven pulley 16, it passes over weighing means 18 which weighs the amount of coal being fed to the inlet chute 20 of rod mill 22. The information on the weight of coal fed is sent as an electrical signal by means of coal feed signal line 24 to weighbelt feeder controller 26. Weighbelt feeder controller 26 can be any conventional recording and controlling instrument on pnuematic or analog or digital electrical service which is capable of sending information to the master controller as to the amount of coal fed to the rod mill. In practice, it is desired to set a fixed coal feed level and then adjust the liquid fed to achieve the desired slurry product 30 exiting rod mill 22.

Also entering inlet chute 20, is the liquid material, illustrated by feedwater and shown schematically by the arrow 2, via feedwater conduit 32. The amount of water fed to the rod mill 22 is critical to maintaining the viscosity and stability of the product slurry and producing a uniform slurry product 30. With all other variables being held, or attempted to be held, constant, the amount of liquid material or water added is the controlling factor with respect to the uniformity of the slurry product 30. Feedwater 2 supply is controlled by control valve 34 which in turn is regulated via pressure line 36 through current/pressure transformer 38 which in turn is activated by control valve signal line 40. Signal line 40 is activated by master mill controller 42 to cause a change, either opening or closing, of control valve 34. Master mill controller 42 receives input signals from the weighbelt feeder controller 26 via signal line 44, flow meter 46 via flow transmitter 48 via signal line 50 and amp controller 52 via signal line 54. Amp controller 52 in turn receives a signal from the current transformer 56 via signal line 58 indicating the current draw or amperage in electrical supply line 60 required by mill motor 62 to turn the rod mill 22. Rod mill 22 is rotated in conventional fashion through gear reduction box and ring gear equipment not shown.

In operation the control scheme provides that the amperage required to turn the mill motor and thus the rod mill at a given speed to provide a uniform slurry product is set in the amp controller 52 and provided to master mill controller 42 as the set point. The master mill controller 42 then operates control valve 34 to provide sufficient water 2 to produce a slurry product 30 of uniform and consistent quality. In other words, the uniform and consistent slurry product is proportional to the amperage drawn by the mill motor and is controlled in that fashion. If the coal feed were consistent, then mere ratio control of the liquid feed material could be used to provide a uniform and consistent slurry product 30. However, the solids content of coal fed to the inlet chute 20 varies depending on the type, mine, water content, and atmospheric conditions. These variables act to cause variation in the actual amount of coal fed into inlet chute 20. When the amount of the coal fed varies then the amount of water must also be changed for uniform and consistent product slurry. It has been found that the energy required to rotate the rod mill, that is the current supplied to the mill motor is proportional to the viscosity of the product slurry. Therefore, if the amperage drawn by the mill motor is set constant and the feedwater is varied as required to maintain the amperage drawn by the mill motor, the slurry product will be maintained as a uniform and consistent slurry product. Of course when plant upsets occur then an alternate scheme of ratio control between coal and water can be used to provide an acceptable product slurry. However, it is preferred to operate on amperage control whenever possible.

The uniform and consistent slurry product 30 has a solids conentration of from about 48 to about 54 percent by weight of subbituminous coal, and preferably from about 52 to about 54 percent by weight of coal. For bituminous coals, a consistent and uniform slurry product preferably having from about 60 to about 65 percent by weight solids concentration.

Once the slurry product 30 is produced it is fed to a mill product tank 64 and from there via pump suction conduit 66, it is pumped by product pump 68 to the slurry product storage facility (not shown).

The amperage control scheme and method of operating a rod mill provided by this invention is of course, applicable to any rod mill operation or indeed the operation of any similar type size reduction equipment, which uses a wet process and produces a slurry. Typical of these are other types of rod mills, ball mills, tube mills, compartmented ball mills, pebble mills and the like. It is only necessary to maintain the medium as consistent as possible so that the amperage drawn will be proportional in the same amount to the energy required to produce the the desired product slurry.

What is claimed is:

1. A method for operating a rod mill for the production of a uniform product slurry, said method comprising the steps of a) weighing a solid friable material on a continual basis as a first feed stream to the inlet chute of said rod mill.

b) measuring a liquid material as a second feed stream to said chute, c) feeding to said chute a predetermined ratio of said first feed stream and said second fed stream, said second feed stream forming the continuous phase of said slurry, and d) controlling said second feed stream in relation to said first feed stream so that the predetermined amount of current drawn by the motor for rotation of said rod mill will result in a consistent solids concentration, thereby forming a uniform slurry product of predetermined viscosity based on the ratio of said friable solid material to said liquid material fed and said current drawn by said motor.

2. The method of claim 1 in which said controlling of said step (d) is carried out by an ammeter electrically connected to said rod mill motor and the data from said ammeter is used to control said second feed stream in said step (b).

3. The method of claim 1 wherein said weighing of said step (a) is carried out using a continuous weighbelt feeder and the data from the weighbelt feeder is used to set the speed at which the weighbelt feeder operates to feed said solid friable material to said chute.

4. The method of claim 2 wherein said measuring of said step (b) is carried out using a control valve the opening or closing of which is controlled by the set point of said ammeter for the current drawn by said rod mill motor and said control valve measures the amount of said second feed stream to said chute.

5. The method of claim 2 further characterized in that said weighing of said step (a) is carried out using a continuous weighbelt feeder and the data from the weighbelt feeder is used to set the speed at which the weighbelt feeder operates to feed said solid friable material to said chute and said measuring of said step (b) is carried out using a flow meter and the data from said flow meter is used to set a control valve to feed said liquid material to said chute.

6. The method of claim 5 further characterized in that the data from said weighing, said measuring and said controlling are automatically and continuously input to a master controller which compares the input data to predetermined values and adjusts the position of said control valve or the rotation of said rod mill, as and if required whereby a uniform slurry is produced.

7. The method of claim 6 wherein said solid friable material is coal and said liquid material is water so that a slurry of coal in water is produced.

8. The method of claim 7 further characterized in that said coal in said slurry has a particle size of from about 44 to about 2360 microns.

9. The method of claim 7 further characterized in that said coal is a subbituminous coal and by said slurry having a solids content of from about 48 to about 54 percent by weight of coal.

10. The method of claim 9 wherein said solids content of said slurry is from about 52 to about 54 percent by weight.

11. The method of claim 7 further characterized in that said coal is a bituminous coal and by said slurry having a solids content of from about 60 to about 65 percent by weight of coal.

* * * * *